US006352807B1

(12) United States Patent
Lee et al.

(10) Patent No.: US 6,352,807 B1
(45) Date of Patent: Mar. 5, 2002

(54) IMAGE FORMING METHOD AND APPARATUS HAVING A PHOTORECEPTOR WEB

(75) Inventors: Won-hyung Lee, Seoul; Wan-ha Kim, Suwon; Seung-deog An, Yongin, all of (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/672,025

(22) Filed: Sep. 29, 2000

(30) Foreign Application Priority Data

Oct. 27, 1999 (KR) ..... 99-46895

(51) Int. Cl.[7] ..... G03G 13/16; G03G 13/20

(52) U.S. Cl. ..... 430/66; 430/126; 399/329; 399/335

(58) Field of Search ..... 430/124, 66; 399/96, 399/335, 162

(56) References Cited

U.S. PATENT DOCUMENTS 5,418,105 A * 5/1995 Wayman et al. ..... 430/124
5,953,561 A * 9/1999 Tashiro et al. ..... 399/111
6,223,017 B1 * 4/2001 Alkutsu et al. ..... 399/330

* cited by examiner

*Primary Examiner*—John Goodrow
(74) *Attorney, Agent, or Firm*—Sughrue Mion, PLLC

(57) ABSTRACT

A photoreceptor web for an image forming apparatus includes a base layer, a conductive ground layer formed on the base layer, and a photosensitive layer formed on the ground layer, where an electrostatic latent image is formed by scanned light. A first protective layer is formed on the photosensitive layer for protecting the photosensitive layer, and a heating layer is formed on a rear surface of the base layer in a predetermined pattern for receiving electric power and generating resistance heat. The photoreceptor web is maintained at a constant temperature by the resistance heat generated by the heating layer.

12 Claims, 4 Drawing Sheets

IMAGE FORMING METHOD AND APPARATUS HAVING A PHOTORECEPTOR WEB

BACKGROUND OF THE INVENTION

1. Field of the Invention

The present invention relates generally to printers and, more particularly, to an image forming method and apparatus having a photoreceptor web which can be directly heated.

2. Description of the Related Art

In general, an image, forming apparatus such as a liquid electro-photographic printer, as shown in FIG. 1, includes a photoreceptor web 10 that circulates and is supported by a plurality of support rollers 11, and a plurality of laser scanning units 12, a plurality of development units 13, a drying unit 17 and a transfer unit 19, which are sequentially arranged in a direction that the photoreceptor web 10 proceeds. The laser scanning units 12 and the development units 13 are alternately installed. The laser scanning units 12 scan light onto the photoreceptor web 10 to form an electrostatic latent image. Each of the development units 13 develops the electrostatic latent image with a predetermined developer to form a developed image, and includes a developing roller 14 for developing the electrostatic latent image, and a squeegee roller 15 for squeegeeing the developed developer so that the liquid carrier is removed from the developer. The drying unit 17 includes a drying roller 16 for drying the carrier remaining on the photoreceptor web 10. The transfer unit 19 includes a transfer roller 18 for transferring the image passing through the transfer unit 19 to a sheet of print paper P.

In the above structure, the developer that is developed by the development unit 13 comprises ink which is a mixture of a powdered toner having a predetermined color and a liquid carrier that works as a solvent. The developer is supplied to a development gap G between the photoreceptor web 10 and the developing roller 14. The developer is moved to the electrostatic latent image due to a difference between the level of electric potential applied to the developing roller 14 and that of the electrostatic latent image. Toner of the ink used for the development is made filmy by the squeegee roller 15 and becomes a toner image while most of the carrier is squeegeed and removed. The small amount of carrier remaining on the photoreceptor web 10 is dried by the drying unit 17.

In the above image forming process, the efficiency of squeegeeing the carrier with the squeegee roller 15 greatly affects not only the quality of the toner image which is formed to be filmy, but also the performance of the drying roller 16 and the transfer roller 18. For example, since the amount of carrier to be dried by the drying unit 17 decreases as the efficiency of squeegeeing by the squeegeeing roller 15 is improved, the time for drying carrier can be reduced. When the carrier drying time decreases, the number of consecutively printed papers increases. Also, the life span of the drying roller 16 and the transfer roller 18 extends.

Studies to improve the efficiency of squeegeeing have been widely made. There has been a recent report that the efficiency of squeegeeing is closely related to the glass transfer temperature Tg of ink or temperature of the photoreceptor web 10. It is widely known that a glass transfer temperature value of −1 Tg is an appropriate value. The efficiency of squeegeeing increases as the value is lower than −1 Tg to a degree. However, according to the results of various experiments, when the glass transfer temperature is lowered under −10 Tg, many problems are generated. For example, there is wash-off in which the filmy toner image is developed by another developing unit for another color and partially lost; dry picking in which the toner image is tore off by the drying roller 16; and transfer error in which the toner image is not completely transferred to the print paper and remains on the transfer roller 18 as a latent image.

A method to improve the squeegeeing efficiency is to constantly maintain the temperature of the photoreceptor web 10. For this purpose, a conventional heating apparatus is used which includes an additional heating means (not shown) for indirectly heating the photoreceptor web 10, a temperature detecting sensor (not shown) for measuring the temperature of the photoreceptor web 10, and a means for preventing overheating. However, the apparatus has drawbacks because the number of parts is increased which complicates the structure and raises the cost. Also, since the heat loss is continuously generated from the photoreceptor web 10 due to the ink, the temperature of the photoreceptor web 10 cannot be constantly maintained.

SUMMARY OF THE INVENTION

To solve the above problems, it is an objective of the present invention to provide a photoreceptor web and an image forming apparatus and method having an improved structure in which the temperature of the photoreceptor web can be constantly maintained by directly heating the photoreceptor web so that the efficiency of squeegeeing and drying is improved.

Accordingly, to achieve the above objective, there is provided a photoreceptor web for an image forming apparatus which comprises a base layer having a front and rear surface, a conductive ground layer formed on the front surface of the base layer, and a photosensitive layer formed on the ground layer, where an electrostatic latent image is formed by scanned light. The invention further includes a first protective layer formed on the photosensitive layer, which protects the photosensitive layer, and a heating layer formed on the rear surface of the base layer in a predetermined pattern, which receives electric power and generates resistance heat, wherein the photoreceptor web is maintained at a constant temperature by the resistance heat generated by the heating layer.

It is preferred in the present invention that the first protective layer comprises a barrier layer formed on the photosensitive layer, which prevents intrusion of foreign materials into the photosensitive layer, and a release layer formed on the barrier layer, where an image is formed.

It is also preferred in the present invention that a pair of power terminals, which receive the electric power, are exposed at each of both side portions of the heating layer.

It is also preferred in the present invention that the photoreceptor web further comprises a second protective layer coated or positioned on a surface of the heating layer to prevent damage to the heating layer.

Further, it is preferred in the present invention that the second protective layer is formed of a material selected from the group consisting of silicon, polyamide and polyethylene.

To achieve another aspect of the present invention, there is provided an image forming apparatus which comprises a photoreceptor web supported by a plurality of support rollers, which is operative to circulate along a predetermined path, a laser scanning unit, positioned proximate to the photoreceptor web, which scans light onto the photoreceptor web to form an electrostatic latent image, a developing unit, which develops the electrostatic latent image using a developer to form an image, a drying unit, which dries the photoreceptor web, a transferring unit, which transfers the image formed on the photoreceptor web to a printable medium, such as a sheet of print paper, and a power supply unit, which supplies power, which heats the photoreceptor web. Here, the photoreceptor web comprises a base layer, a conductive ground layer formed on the base layer and a photosensitive layer formed on the ground layer, where an electrostatic latent image is formed by the light scanned by the laser scanning unit. A first protective layer is formed on the photosensitive layer, which protects the photosensitive layer, and a heating layer is formed on a rear surface of the base layer in a predetermined pattern, which receives the power from the power supply unit and generates resistance heat, wherein the photoreceptor web is maintained at a constant temperature by the resistance heat generated by the heating layer.

In a preferred embodiment according to the present invention, the power supply unit comprises a support bracket installed adjacent to the photoreceptor web, a conductive roller rotatably installed at the support bracket to be passively rotated in contact with the side portion of the heating layer, a conductive elastic bar supported at the support bracket that elastically presses the conductive roller toward the heating layer, and a power source electrically connected to the elastic bar.

It is preferred in the present invention that the power supply unit comprises a support bracket installed adjacent to the photoreceptor web, a brush member supported at the support bracket and having a conductive brush which elastically contacts an exposed side portion of the heating layer, and a power source electrically connected to the conductive brush for supplying an electrical signal.

It is also preferred in the present invention that the photoreceptor web further comprises a power terminal which is exposed from both side portions of the heating layer and is electrically connected to the power supply unit.

It is also preferred in the present invention that the photoreceptor web further comprises a second protective layer coated or positioned on a surface of the heating layer to prevent damage to the heating layer.

Also, it is preferred in the present invention that the second protective layer is formed of a material selected from the group consisting of silicon, polyamide and polyethylene.

A method of forming an image on a heat-maintained photoreceptor web is also contemplated and comprises rotating the photoreceptor web by a plurality of support rollers, supplying power to a heating layer of the photoreceptor web by continuously moving the photoreceptor web in contact with a power source and generating resistance in the heating layer using the supplied power so that heat is produced in the heating layer. The method also includes maintaining the heat in the heating layer wherein the photoreceptor web is maintained at a constant temperature, scanning light onto the photoreceptor web to form an electrostatic image, and developing the electrostatic image using a developer to form an image. The photoreceptor web is then dried and the image formed on the photoreceptor web is transferred to a printable medium.

BRIEF DESCRIPTION OF THE DRAWINGS

The above objective and advantages of the present invention will become more apparent by describing in detail a preferred embodiment thereof with reference to the attached drawings, in which.

DETAILED DESCRIPTION OF THE PREFERRED EMBODIMENTS

Figure 1:
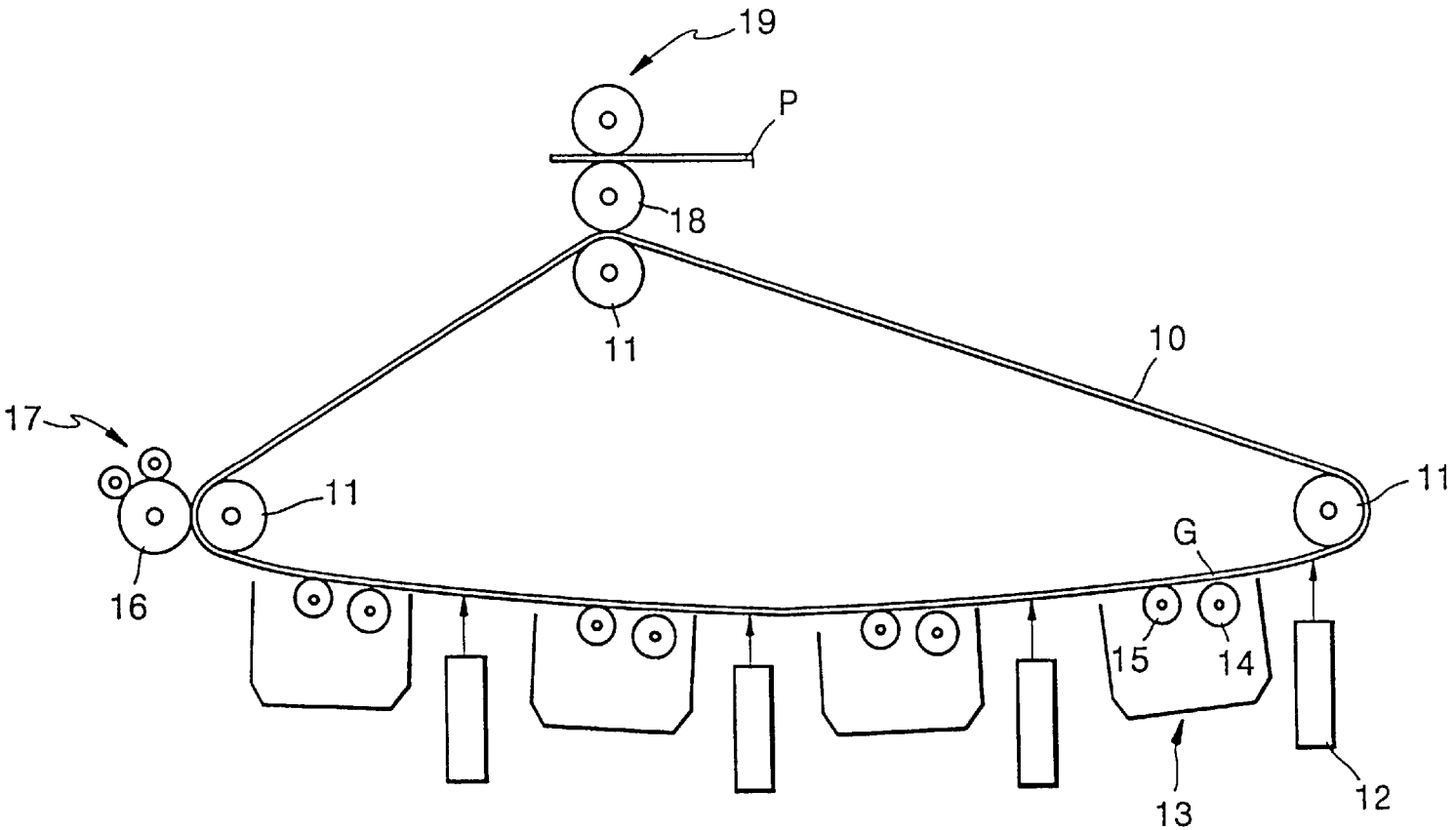
FIG. 1 (PRIOR ART)
FIG. 1 is a view showing the structure of a general image forming apparatus.
Figure 2:
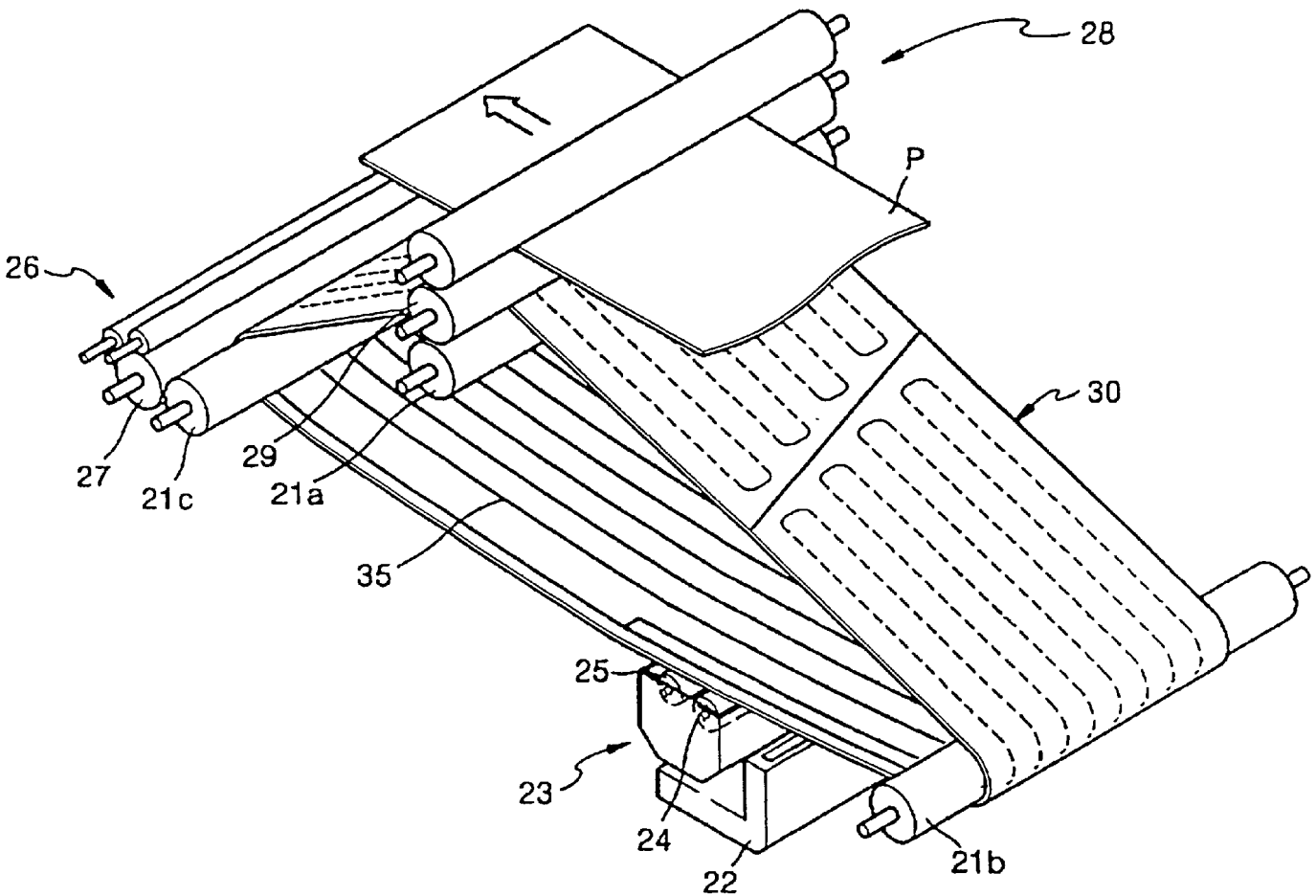
FIG. 2 is a perspective view showing the structure of an image forming apparatus in an operative relationship with a photoreceptor web according to a preferred embodiment of the present invention.
Figure 3:
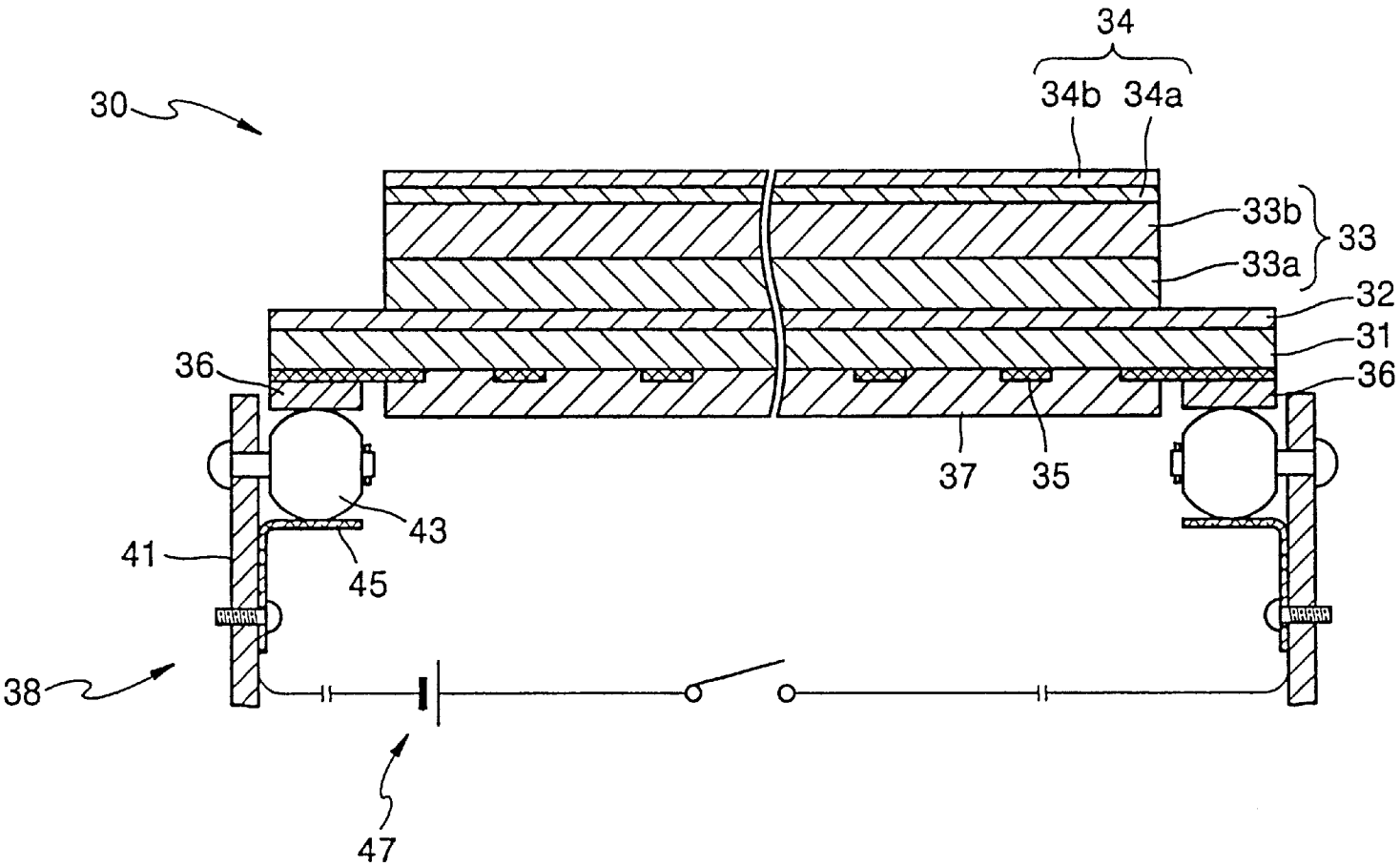
FIG. 3 is a sectional view showing the photoreceptor web of FIG. 2 and a power supply unit which is not shown in FIG. 2.

Referring to FIGS. 2 and 3, an image forming apparatus according to a preferred embodiment of the present invention includes a photoreceptor web 30 installed to circulate along an endless path, a laser scanning unit 22, a developing unit 23, a drying unit 26, a transfer unit 28 and a power supply unit 38.

The laser scanning unit 22 scans light onto the photoreceptor web 30 to form an electrostatic latent image corresponding to image data. The developing unit 23 develops the electrostatic latent image using a developer or ink which is a mixture of a powdered toner and a liquid carrier to form an image. The developing unit 23 includes a developing roller 24 and a squeegee roller 25. The developing roller 24 is rotatably installed and maintains a development gap between the photoreceptor web 30 and the developing roller 24, to develop the electrostatic latent image using the ink. The squeegee roller 25 is installed to be capable of rotating in contact with the photoreceptor web 30 so as to squeegee the ink used for the development and remove the liquid carrier.

The drying unit 26 includes a drying roller 27 for drying the liquid carrier remaining on the photoreceptor web 30. The drying roller 27 is installed along the photoreceptor web's 30 path of circulation, downstream from the developing unit 23 and rotates in contact with the photoreceptor web 30. The transfer unit 28 includes a transfer roller 29 for transferring the image formed on the photoreceptor web 30 to a sheet of print paper P. The transfer roller 29 is installed downstream from the drying roller 27 and rotates in contact with the photoreceptor web 30.

The photoreceptor web 30 is supported by a transfer backup roller 21*a*, a steering roller 21*b* and a driving roller 21*c*, which are indicated by imaginary lines, and circulates in one direction. The photoreceptor web 30, as shown in FIG. 3, is formed of a base layer 31, a conductive ground layer 32 formed on the base layer 31, and a photosensitive layer 33 formed on the ground layer 32. A first protective layer 34 is formed on the photosensitive layer 33 for protecting the photosensitive layer 33, and a heating layer 35 is formed on the rear surface of the base layer 31 in a predetermined pattern.

The base layer 31 corresponds to a basic frame of the photoreceptor web 30. Thus, the base layer 31 is formed of a strong material such as polyester to prevent damage to the photoreceptor web 30.

The ground layer 32 is exposed to the outside so that it can be electrically connected by contacting a predetermined grounding means (not shown). The ground layer 32 is formed of a conductive material such as aluminum (Al).

The photosensitive layer 33 is photosensitized by the light scanned by the laser scanning unit 22. Accordingly, the photosensitized portion is charged to an electric potential that is different from an unphotosensitized portion, thus forming an electrostatic latent image. The photosensitive layer 33 comprises a charge transfer layer 33*a* formed on the ground layer 32 and a charge generation layer 33*b* formed on the charge transfer layer 33*a*. The charge transfer layer 33*a* is a path through which positive charges generated by the charge generation layer 33*b* by the scanned light are transferred so that the electrostatic latent image can be formed on the charge transfer layer 33*a*.

The first protective layer 34 is a film for preventing damage to the photosensitive layer 33. Also, the first protective layer 34 prevents the intrusion of foreign materials or ions from the outside into the photosensitive layer 33. The first protective layer 34 comprises a barrier layer 34*a* formed on the photosensitive layer 33 and a release layer 34*b*, formed on the barrier layer 34*a*, where an image is formed.

The heating layer 35 is formed by patterning a resistive body having a predetermined thermal resistance coefficient, such as a copper resistance wire, on the rear surface of the base layer 31. The heating layer 35 generates resistance heat by receiving electric power from the power supply unit 38 and heats the photoreceptor web 30. Also, to constantly maintain the temperature of the photoreceptor web 30, the heating layer 35 is preferably formed to have a PTC (positive thermal coefficient) feature. Here, the PTC feature is a technology, for example, which is adopted in a side mirror of a car. That is, as a material contracts/expands according to a change of temperature, a resistance value thereof changes so that resistance heat is selectively generated. The PTC technology is widely used industrially.

The heating layer 35 is preferably formed in an unaligned pattern along the widthwise direction of the photoreceptor web 30. Both end portions of the heating layer 35 are exposed from both side portions of the photoreceptor web 30. Power terminals 36 for connecting end portions of the heating layer 35 to the power supply unit 38, are installed on both end portions of the heating layer 35. The power terminals 36 are preferably formed of a material exhibiting a superior anti-abrasion feature to prevent abrasion due to contact with a conductive roller 43 which will be described later.

Also, the photoreceptor web 30 further includes a second protective layer 37 formed to cover the heating layer 35 to prevent damage to the heating layer 35. The second protective layer 37 is formed by coating the heating layer 35 with a material selected from the group consisting of silicon, polyamide and polyethylene.

The power supply unit 38 includes a support bracket 41 installed adjacent to the photoreceptor web 30, a pair of conductive rollers 43, a conductive elastic bar 45 and a power source 47. The support bracket 41 may be provided to support the rollers 21*a*, 21*b* and 21*c*, or a member additionally installed in the printer.

The conductive rollers 43 are rotatably installed at the support bracket 41 and passively rotated in contact with the power terminal 36 when the photoreceptor web 30 circulates. Thus, to increase a contact force between each of the conductive rollers 43 and the photoreceptor web 30, the conductive elastic bar 45 elastically presses the conductive roller 43 toward the photoreceptor web 30. The conductive elastic bar 45 is installed at the support bracket 43. Each of the conductive rollers 43 and the conductive elastic bar 45 are preferably formed of a metal material to prevent abrasion due to friction therebetween.

Also, the conductive elastic bar 45 is electrically connected to the power source 47. Thus, the power supplied from the power source 47 is transferred to the heating layer 35 via the conductive elastic bar 45, the conductive rollers 43, and the power terminal 36.

In the above structure, the photoreceptor web 30 circulates in one direction during a development process. The conductive rollers 43 are passively rotated by a frictional force with the power terminal 36. When power is supplied to the conductive elastic bar 45 from the power source 47, the supplied power is transferred to the heating layer 35 via the conductive rollers 43 and the power terminal 36. The heating layer 35 receives the power and generates resistance heat to heat the photoreceptor web 30.

The proper temperature of the photoreceptor web 30 to improve the efficiency of squeegeeing of the squeegee roller 25 is about 40–45° C. Thus, by appropriately designing the PTC feature of the heating layer 35, the photoreceptor web 30 can be maintained within a proper temperature range. That is, when the temperature of the photoreceptor web 30 increases over about 45° C., the heating layer 35 changes so that the coefficient of resistance is lowered. Thus, the resistance heat is not generated any more and the temperature of the photoreceptor web 30 is gradually lowered under 45° C. When the temperature of the photoreceptor web 30 is lowered under about 40° C., the resistance coefficient increases and the resistance coefficient of the heating layer 35 changes. Thus, in accordance with the present invention, resistance heat is generated from the heating layer 35 so that the photoreceptor web 30 is heated about 40° C.

Consequently, the photoreceptor web 30 can be constantly maintained within the proper temperature range. As depicted above, since the photoreceptor web 30, is maintained in a proper temperature range by directly heating the same, the efficiency of squeegeeing by the squeegee roller 25 is improved. As the squeegeeing efficiency is improved, printing errors such as wash-off, dry picking and transfer error are prevented.

Also, when the squeegee efficiency is improved, the amount of carrier removed from the squeegee roller 25 increases, while the amount of carrier to be removed from the drying roller 27 relatively decreases. Thus, the time need for the drying unit 26 to dry the carrier on the photoreceptor web 30 is reduced so that the number of consecutively printed papers can be increased. Also, the life span of the drying roller 25 and the transfer roller 29 are extended, thus the need for costly replacement parts is reduced.

Furthermore, since the photoreceptor web 30 can be constantly maintained merely by supplying the power to the heating layer 35, the additional temperature detecting sensor or the overheat preventing means are not necessary.

Figure 4:
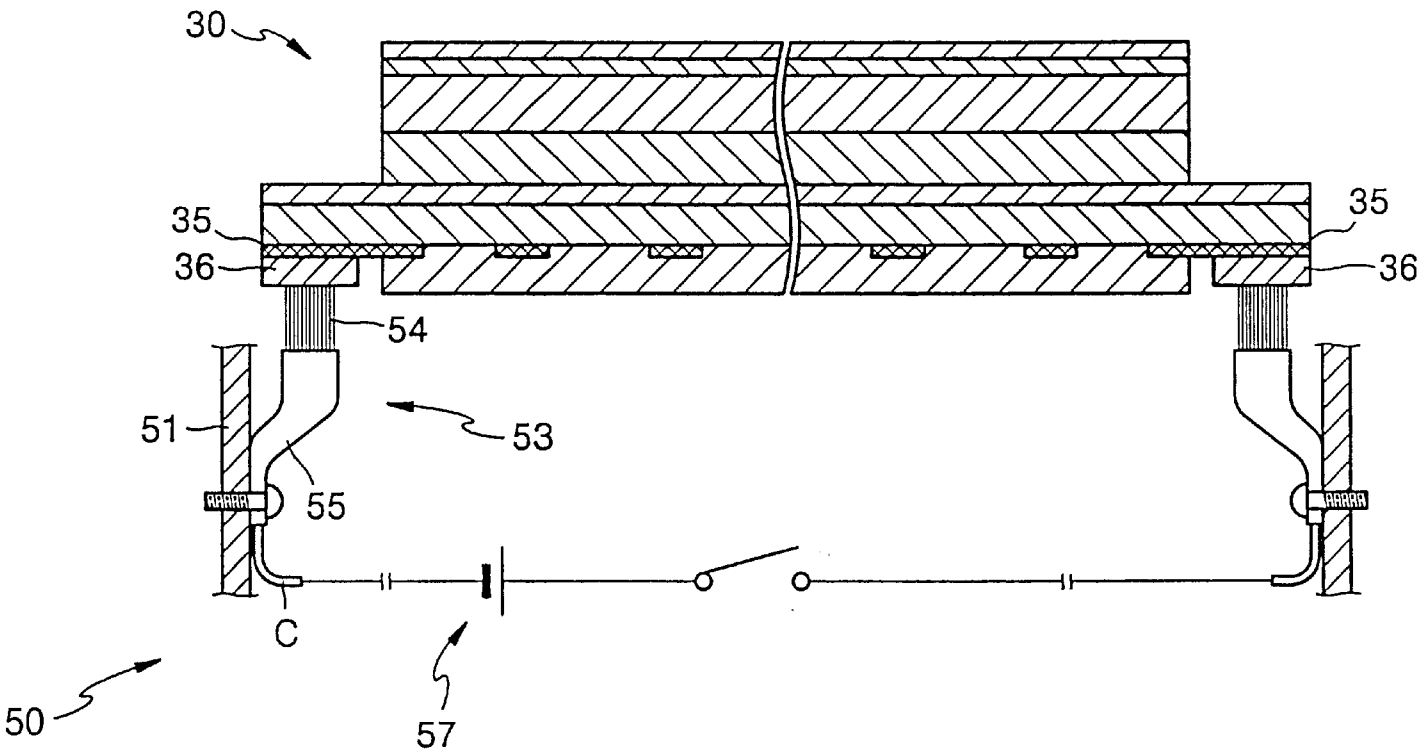
FIG. 4 is a sectional view showing another preferred embodiment of the power supply unit shown in FIG. 3.

FIG. 4 shows another preferred embodiment of a power supply unit 50. The power supply unit 50 includes a pair of support brackets 51 installed adjacent to the photoreceptor web 30, a brush member 53 and a power source 57. The brush member 53 is installed at each support bracket 51. The brush member 53 includes a brush 54 electrically contacting the power terminal 36, and a support portion 55 installed on the support bracket 51 for supporting the brush 54. The brush 54 is formed of a plurality of elastically deformable and conductive wires. Thus, when the photoreceptor web 30 circulates, the brush 54 elastically contacts the power terminal 36 and is electrically connected to the photoreceptor web 30. The brush 54 is connected to the power source 57 through an electric cable C. As a result, the power supplied from the power source 57 is transferred to the heating layer 35 via the brush 54 and the power terminal 36. Then, the heating layer 35 generates resistance heat with the transferred power so as to heat the photoreceptor web 30 to an appropriate temperature. Since the operation and effects of the image forming apparatus having the above-described power supply unit are the same as those described with reference to FIG. 3, descriptions thereof will be omitted.

It is contemplated that numerous modifications may be made to the apparatus and method of the present invention without departing from the spirit and scope of the invention as defined in the claims.

What is claimed is:

1. A photoreceptor web for an image forming apparatus, comprising:

a base layer having a front and a rear surface;

a conductive ground layer formed on the front surface of the base layer;

a photosensitive layer formed on the ground layer, where an electrostatic latent image is formed by scanned light;

a first protective layer formed on the photosensitive layer, which protects the photosensitive layer; and a heating layer formed on the rear surface of the base layer in a predetermined pattern, which receives electric power and generates resistance heat, wherein the photoreceptor web is maintained at a constant temperature by the resistance heat generated by the heating layer.

2. The photoreceptor web as claimed in claim 1, wherein the first protective layer comprises:

a barrier layer formed on the photosensitive layer, which prevents intrusion of foreign materials into the photosensitive layer; and a release layer formed on the barrier layer, where an image is formed.

3. The photoreceptor web as claimed in claim 1, wherein a pair of power terminals, which receive the electric power, are exposed at side portions of the heating layer.

4. The photoreceptor web as claimed in claim 1, further comprising a second protective layer coated on a surface of the heating layer to prevent damage to the heating layer.

5. The photoreceptor web as claimed in claim 4, wherein the second protective layer is formed of a material selected from the group consisting of silicon, polyamide and polyethylene.

6. An image forming apparatus comprising:

a photoreceptor web supported by a plurality of support rollers operative to circulate along an endless path;

a laser scanning unit, which scans light onto the photoreceptor web to form an electrostatic latent image;

a developing unit, which develops the electrostatic latent image using a developer to form an image;

a drying unit, which dries the photoreceptor web;

a transferring unit, which transfers the image formed on the photoreceptor web to a printable medium; and a power supply unit, which supplies power for heating the photoreceptor web, wherein the photoreceptor web comprises:

a base layer having a front and a rear surface;

a conductive ground layer formed on the front surface of the base layer;

a photosensitive layer formed on the ground layer, where an electrostatic latent image is formed by the light scanned by the laser scanning unit;

a first protective layer formed on the photosensitive layer, which protects the photosensitive layer; and a heating layer formed on the rear surface of the base layer in a predetermined pattern, which receives the power from the power supply unit and generates resistance heat, wherein the photoreceptor web is maintained at a constant temperature by the resistance heat generated by the heating layer.

7. The image forming apparatus as claimed in claim 6, wherein the power supply unit comprises:

a support bracket installed adjacent to the photoreceptor web;

a conductive roller rotatably installed at the support bracket to be passively rotated in contact with a side portion of the heating layer;

a conductive elastic bar supported at the support bracket, which is operative to elastically press the conductive roller toward the heating layer; and a power source electrically connected to the elastic bar.

8. The image forming apparatus as claimed in claim 6, wherein the power supply unit comprises:

a support bracket installed adjacent to the photoreceptor web;

a brush member supported at the support bracket, the brush member having a conductive brush, which elastically contacts an exposed side portion of the heating layer; and a power source electrically connected to the conductive brush, which supplies an electrical signal.

9. The image forming apparatus as claimed in claim 6, wherein the photoreceptor web further comprises a power terminal, which is exposed on side portions of the heating layer and electrically connected to the power supply unit.

10. The image forming apparatus as claimed in claim 6, wherein the photoreceptor web further comprises a second protective layer coated on a surface of the heating layer to prevent damage to the heating layer.

11. The image forming apparatus as claimed in claim 10, wherein the second protective layer is formed of a material selected from the group consisting of silicon, polyamide and polyethylene.

12. A method of forming an image on a heat-maintained photoreceptor web, which comprises:

rotating the photoreceptor web by a plurality of support rollers;

supplying power to a heating layer of the photoreceptor web by continuously moving the photoreceptor web in contact with a power source;

generating resistance in the heating layer using the supplied power so that heat is produced in the heating layer;

maintaining the heat in the heating layer wherein the photoreceptor web is maintained at a constant temperature;

scanning light onto the photoreceptor web to form an electrostatic image;

developing the electrostatic image using a developer to form an image;

drying the photoreceptor web; and transferring the image formed on the photoreceptor web to a printable medium.

* * * * *